United States Patent [19]

Dumas

[11] Patent Number: 4,791,724

[45] Date of Patent: Dec. 20, 1988

[54] WEDGE SHAPED RAZOR APPARATUS

[76] Inventor: Jack Dumas, 14111 Occidental Rd., Sebastopol, Calif. 95472

[21] Appl. No.: 57,988

[22] Filed: Jun. 4, 1987

[51] Int. Cl.[4] ..... B26B 21/00

[52] U.S. Cl. ..... 30/89; 30/48

[58] Field of Search ..... 30/47–50, 30/32, 299, 320, 346.5, 89

[56] References Cited

U.S. PATENT DOCUMENTS

| | | | |
|---|---|---|---|
| 228,829 | 6/1880 | Moody . | |
| 1,241,921 | 10/1917 | Carroll . | |
| 1,387,465 | 9/1921 | Browning . | |
| 1,506,533 | 9/1924 | Klecka . | |
| 1,589,826 | 6/1926 | Strand . | |
| 2,517,028 | 9/1950 | Ridner, Sr. . | |
| 4,208,791 | 6/1980 | Van Cleve . | |
| 4,534,110 | 9/1985 | Glass . | |
| 4,720,917 | 1/1988 | Solow | 30/49 |

FOREIGN PATENT DOCUMENTS

| | | | |
|---|---|---|---|
| 139082 | 3/1934 | Austria | 30/299 |
| 863301 | 3/1941 | France | 30/299 |

*Primary Examiner*—Douglas D. Watts

*Attorney, Agent, or Firm*—Limbach, Limbach & Sutton

[57] ABSTRACT

An improved razor apparatus is provided to enable use in two positions for shaving. The improved razor apparatus includes two components, an easily adjustable razor body and a handle. The razor body is comprised of dual razor heads which may be easily adjusted from a wedge-shaped position to a straight edge position, by applying pressure, such as made by a finger, to a hinged razor cap crown connecting the dual razor-heads. The razor body maintains its wedge-shaped position by means of a locking clasp placed between the sides of the hinged razor cap crown. The handle is demountably attached to the dual razor heads by flexible arms, allowing adjustment between the wedge-shaped position and straight edge position without detachment of the pair of arms.

2 Claims, 1 Drawing Sheet

WEDGE SHAPED RAZOR APPARATUS

DESCRIPTION

1. Technical Field

The present invention is directed generally to an improved razor apparatus, and more particularly to a razor apparatus having an adjustable razor head, which can be readily converted between a wedge shape and a straight edge design.

2. Background of the Invention

In the razor apparatus area, there have been a number of razors which have had specialized head configurations. One such example is an arcuate razor head as disclosed by Van Cleve, U.S. Pat. No. 4,208,791, issued June 24, 1980. The head of this prior device was designed to conform to convex and concave body surfaces. The head had an arcuate face with an opposing straight face.

The drawbacks to such an apparatus were multiple. The arcuate shape was cumbersome since the razor head was an extension of the handle, lying in the same relative plane. Furthermore, the shape of the razor head could not be manipulated, nor could the head be positioned so as to be angled from the handle position. Moreover the razor head, because of the location of the head to the handle, did not provide a close shave.

Examination of other prior devices reveals razor head configurations which are generally V-shaped in appearance. These apparatuses are disclosed in Moody, U.S. Pat. No. 228,829, issued June 15, 1880; Klecka, U.S. Pat. No. 1,506,533, issued Aug. 26, 1924; Atrand, U.S. Pat. No. 1,589,826, issued June 22, 1926; Kidner, U.S. Pat. No. 2,517,028, issued Aug. 1, 1950; Carroll, U.S. Pat. No. 1,241,921, issued Oct. 2, 1917; Browning, U.S. Pat. No. 1,387,465, issued Aug. 16, 1921; and Glass, U.S. Pat. No. 4,534,110, issued Aug. 13, 1985.

Each of these inventions suffered from a number of deficiencies. One such deficiency was the non-adjustability of the razor head from V-shape position to a straight edge position. Even those devices, such as illustrated in Browning, where adjustablity was disclosed, were not designed to be used in a straight edge position while shaving.

Other deficiencies included the non-disposability of the razor head.

A further disadvantage of prior razor head devices was the heavy and cumbersome nature of the entire apparatus.

Another deficiency was the inability to attain a close shave with the prior devices' V-shaped razor head configuration. Some of these configurations were too wide or ill designed to adequately come in contact with a substantial portion of the user's skin. Other configurations were shaped as an inverted V and had the same deficiency.

It is therefore an object of the present invention to provide an improved razor apparatus having two positions for use in shaving.

It is a further object of the present invention to provide an improved razor apparatus which is easily adjustable from a wedge-shaped position to a straight edge position by means of dual razor heads.

It is another object of the present invention to provide an improved razor apparatus, whose position may be easily adjusted from wedge-shaped position to straight edge position by the application of pressure, such as made by a finger, to a cap crown connecting the dual razor heads.

It is yet another object of the present invention to provide an improved razor apparatus, wherein the dual razor heads are connected by a cap crown which acts as a hinge.

It is still a further object of the present invention to provide an improved razor apparatus which maintains its wedge shaped position by means of a locking clasp between the dual razor heads.

It is still another object of the present invention to provide an improved razor apparatus wherein the wedge-shaped configuration of the dual razor heads provides for an extremely close shave.

It is a further object of the present invention to provide an improved razor apparatus wherein the dual razor heads are easily removed for cleaning or disposal.

These and other features, objectives and advantages of the present invention will be more readily understood upon consideration of the following detailed description of certain embodiments of the present invention and the accompanying drawings.

DISCLOSURE OF INVENTION

These and other problems of prior razor devices are overcome by the present invention of an improved razor apparatus of the type including a handle with flexible arms, dual adjustable razor head and a hinged razor cap crown/clasp arrangement, wherein the razor head may easily be adjusted from a wedge-shaped position to a straight edge position.

The improvement comprises a handle with flexible arcuate arms which demountably attach to dual razor heads. The dual razor heads are connected to one another by a locking clasp and a hinged cap crown. The razor cap crown is a flat plane when the razor head is in the wedge-shaped position. When pressure, such as exerted by a finger, is applied to the hinged razor cap crown, the razor cap crown becomes unhinged and the clasp is unlocked, allowing the present invention to be used in a straight edge position. The razor user may regain and maintain the wedge-shaped position by applying pressure to the sides of the dual razor heads, wherein the clasp between the dual razor heads locks and the hinged razor cap crown to resumes its hinged position. The flexible arms allow for the adjustment of the dual razor heads from wedge-shaped position to straight edge position without detachment from the dual razor heads.

Furthermore, in accordance with the present invention, the improved razor apparatus is provided with easily removable and disposable dual razor heads, aiding in cleaning of the entire apparatus. These removable and disposable heads are also more economical than ordinary razor blades.

Moreover, the wedge-shaped position of the dual razor heads, as embodied in the present invention, enables the user to attain a closer shave than normal with a ordinary razor. The wedge-shaped configuration allows for a closer shave since the wedge shape of the dual razor head conforms to the user's skin and the blades clamped within the dual razor heads are flush with the skin surface and hair.

BEST MODE FOR CARRYING OUT THE INVENTION

Figure 1:
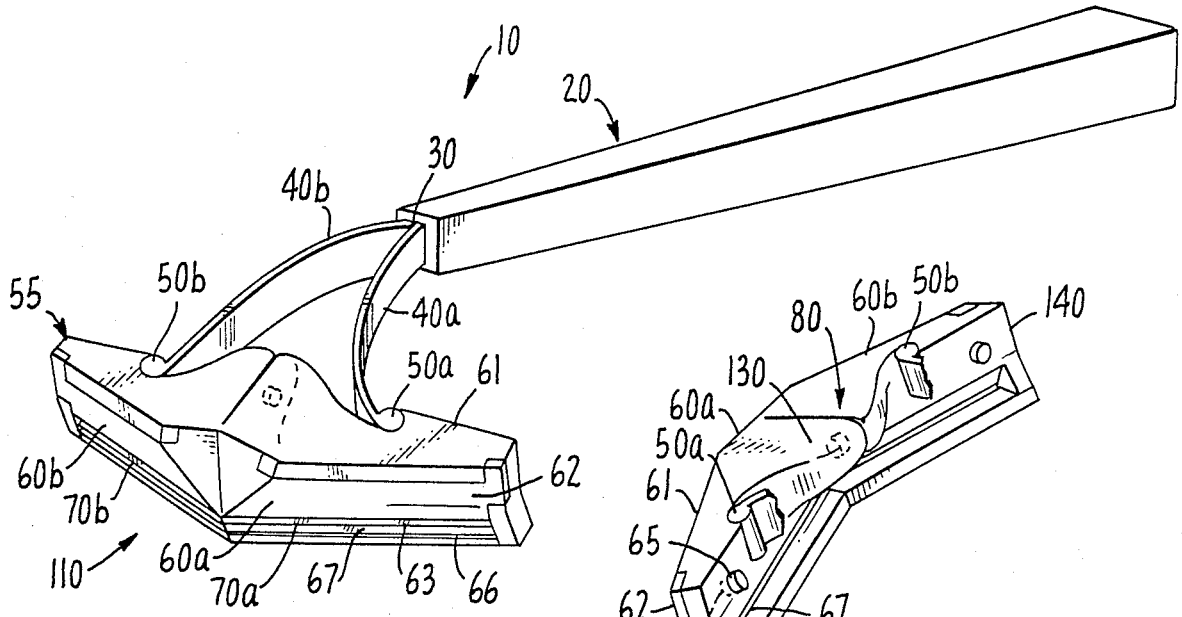
FIG. 1 is a front perspective view of a razor apparatus, with dual razor heads in wedge-shaped position, embodying the principles of the invention.

Referring to FIG. 1, a razor apparatus 10 is shown with an elongated handle 20. The razor body generally designated 55, is composed of dual razor heads 60*a* and 60*b*. The dual razor heads 60*a* and 60*b*, have structural features of the type disclosed in Dorion, U.S. Pat. No. 3,724,070, incorporated herein by reference. Each dual razor head 60*a* and 60*b* is a unitary assembly having a main body 61 and a cap 62. Sandwiched between the upper surface of a cavity in main body 61 and the underside cap 62 is a cutting blade 63. This cutting blade is secured in an accurately predetermined position in a manner well known to persons skilled in this art and here represented by one or more assembly bosses 64 extending through an assembly opening 65 in main body 61. The cutting edge of cutting blade 63 is arranged facing towards guard member 66 along the forward edge of the dual razor heads 60*a* and 60*b*.

Additional features of the dual razor heads 60*a* and 60*b* include an elongated passage 67 extending through the main body 61 and underlying the cutting edge of cutting blade 63 to provide an escape passage for cuttings.

A pair of arms 40*a* and 40*b* are securely fixed in the longitudinal face 30 of the elongated handle 20. The pair of arms 40*a* and 40*b* are of arcuate shape, gradually flaring outwards, away from the longitudinal face 30 of the elongated handle 20. The pair of arms 40*a* and 40*b* are flexible and may be constructed from metal, such as stainless steel.

Each arm 40*a* and 40*b* ends in a barrel shaped member 50*a* and 50*b*. Each barrel shaped member 50*a* and 50*b* is demountably attached to each dual razor head 60*a* and 60*b*, by way of housing located on the posterior face of razor heads 60*a* and 60*b*.

A razor cap crown 90 connects the dual razor heads 60*a* and 60*b*. Each of the dual razor heads 60*a* and 60*b*. forms one side of razor cap crown 90. The razor cap crown 90 acts as a hinge secored to each of the dual razor heads 60*a* and 60*b*.

A two part locking clasp generally designated 80 is mounted to each side 100*a* and 100*b* of the razor cap crown 90, with a single part of clasp 80 attached to each side 100*a* and 100*b*.

Clasp 80 locks when pressure is applied to the sides 140 of razor body 55, thus maintaining the wedge-shaped position 110. When direct pressure, such as exerted by the user's finger, is applied to razor cap crown 90, razor cap crown 90 unhinges and clasp 80 unlocks. When razor cap crown 90 is in the unhinged position, razor body 55 assumes an retains the straight edge position 120.

Figure 2:
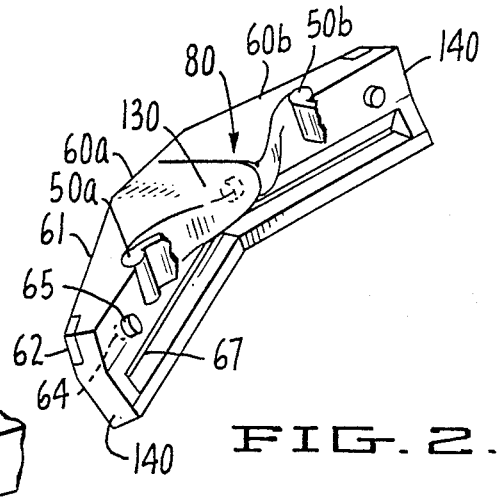
FIG. 2 is a posterior perspective view of the razor apparatus shown in FIG. 1.
Figure 3:
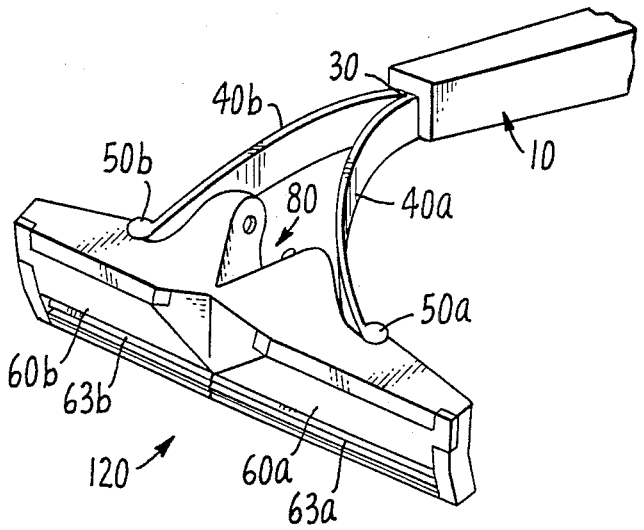
FIG. 3 is a front perspective view of the razor apparatus with dual razor heads in straight edge position.

FIG. 2 shows the present invention in wedge shaped position generally designated 110, and in FIG. 3, razor body 55 is shown in straight edge position 120. Cutting blades 63*a* and 63*b* slightly overlap so as to provide a cutting edge which is smooth and without sharp edges.

Figure 4:
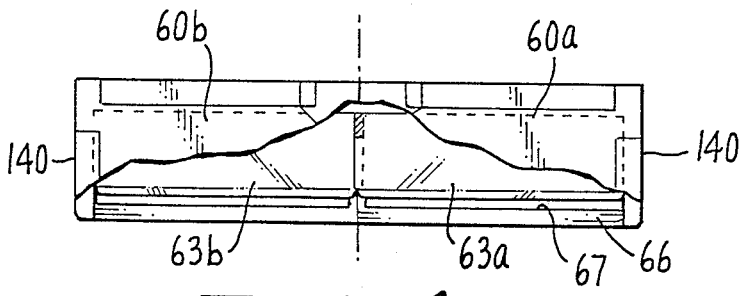
FIG. 4 is a top view of the razor apparatus, with dual razor heads shown in schematic perspective.

FIG. 4 illustrates a top view of the present invention in schematic detail, showing the manipulation of the razor body 55 from wedge-shape position 110 to straight edge position 120 without removal of the pair of arms 40*a* and 40*b*.

Figure 5:
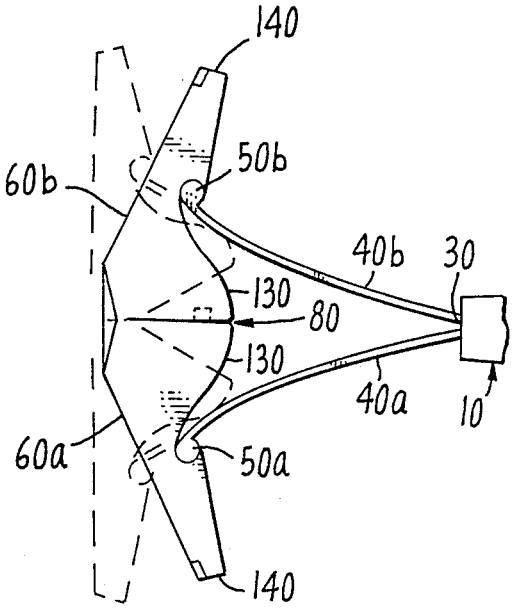
FIG. 5 is an enlarged front prospective cut-away view of the dual razor heads in straight edge position.

FIG. 5 is an enlarged cut-away front prospective of FIG. 3.

In the preferred embodiment of the present invention, the dual razor heads 60*a* and 60*b* are extremely rugged, non-elastic and impervious to moisture.

In the preferred embodiment of the present invention, the elongated handle 20 is light, yet sturdy, allowing for extended use and durability.

Moreover in the preferred embodiment, the pair of arms 40*a* and 40*b* can be constructed of metal, such as stainless steel. This material is flexible, strong and rust resistant.

The two part locking clasp 80 can be a magnet, locking snap or any other such device.

Finally, in the preferred embodiment of the present invention, the cutting blades 63*a* and 63*b* can be stainless steel. Stainless steel razor blades are durable, light and retain a sharp edge.

The terms and expressions which have been employed herein are used as terms of description and not of limitation, and there is no intention, in the use of such terms and expressions, of excluding equivalents of the features shown and described, or portions thereof, it being recognized that various modifications are possible within the scope of the invention claimed.

What is claimed is:

1. A razor apparatus for use in shaving comprising:

an elongated handle having a pair of arms fixedly attached to said handle;

dual razor heads which engage said pair of arms, said razor heads forming a wedge shape;

wherein said razor apparatus is convertible from said wedge shape to a straight edge;

wherein said arms engage and are fixedly attached to said handle at a common point and whereafter each of said arms flare outward from the others; and wherein said arms have an arcuate shape.

2. A razor apparatus according to claim 1 where said arms are composed of a flexible, rust resistant and durable metal.

* * * * *